US008156874B2

(12) United States Patent
Hansen

(10) Patent No.: US 8,156,874 B2
(45) Date of Patent: Apr. 17, 2012

(54) OVERHEAD CONVEYOR

(75) Inventor: Steen Hansen, Slagelse (DK)

(73) Assignee: Invacare International SARL, Gland (CH)

( * ) Notice: Subject to any disclaimer, the term of this patent is extended or adjusted under 35 U.S.C. 154(b) by 545 days.

(21) Appl. No.: 12/294,718

(22) PCT Filed: Mar. 29, 2007

(86) PCT No.: PCT/IB2007/051124

§ 371 (c)(1),
(2), (4) Date: Feb. 25, 2009

(87) PCT Pub. No.: WO2007/110846

PCT Pub. Date: Oct. 4, 2007

(65) Prior Publication Data

US 2009/0308828 A1 Dec. 17, 2009

(30) Foreign Application Priority Data

Mar. 29, 2006 (EP) ..... 06111947

(51) Int. Cl.
*B61B 3/02* (2006.01)

(52) U.S. Cl. ..... 105/153; 105/155

(58) Field of Classification Search ..... 105/30, 105/32, 33, 148, 150, 153–155, 73, 75
See application file for complete search history.

(56) References Cited

U.S. PATENT DOCUMENTS

| | | | | |
|---|---|---|---|---|
| 3,262,400 | A * | 7/1966 | Henderson | 105/73 |
| 3,380,398 | A * | 4/1968 | Wainwright et al. | 105/30 |
| 3,498,236 | A * | 3/1970 | Meek | 105/30 |
| 4,372,452 | A * | 2/1983 | McCord | 212/285 |
| 5,676,189 | A * | 10/1997 | Zeeb | 160/331 |
| 6,050,198 | A | 4/2000 | Gersemsky et al. | |
| 6,910,425 | B2 * | 6/2005 | Galpin et al. | 105/30 |
| 2004/0040462 | A1 * | 3/2004 | Marchiori et al. | 105/247 |

FOREIGN PATENT DOCUMENTS

| | | |
|---|---|---|
| DE | 331899 | 1/1921 |
| DE | 1125614 | 3/1962 |
| DE | 3432045 | 3/1986 |
| GB | 495377 | 11/1938 |
| WO | 2007/110846 | 10/2007 |
| WO | WO 2008/029272 | 3/2008 |

OTHER PUBLICATIONS

International Search Report from PCT/IB2007/051124, mailed Aug. 24, 2007.

* cited by examiner

*Primary Examiner* — S. Joseph Morano
*Assistant Examiner* — Zachary Kuhfuss
(74) *Attorney, Agent, or Firm* — Calfee, Halter & Griswold, LLP

(57) ABSTRACT

The rail mounted displaceable device is a ceiling mounted hoist comprising two pairs of carrying wheels (2) arranged to run in the rail (1) and two motion wheels (4) actuated by a motor (7). The motion wheels (4) are rotatably fixed on a hinged bracket (5) which is pivotably connected via a hinge (6) to a chassis (3). The displaceable device is provided with an actionable solenoid (8) for pressing said transport wheels (4) against the rail (1) in order to allow a displacement of the device along the rail (1) when the motor (7) is activated and to allow the carrying wheels (2) to rotate freely along the rail (1) when said motor (7) is deactivated.

15 Claims, 4 Drawing Sheets

OVERHEAD CONVEYOR

Figure 1:
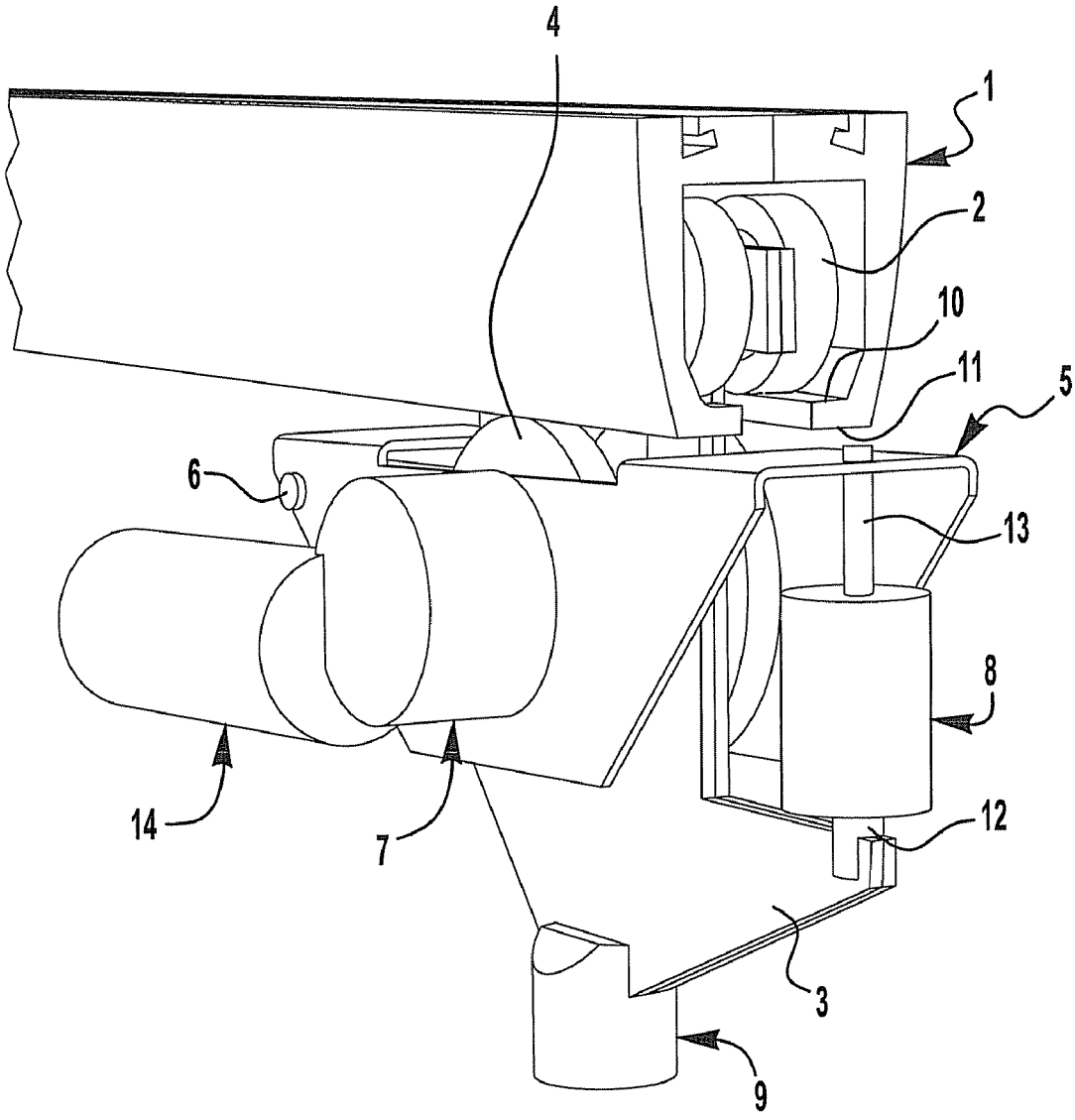

This application is the U.S. national phase entry of PCT/IB2007/051124, with an international filing date of Mar. 29, 2007, which claims the benefit of European patent application serial no. 06111947.5, filed Mar. 29, 2006, the entire disclosures of which are fully incorporated herein by reference.

The invention relates to a rail mounted displaceable device, preferably for a ceiling mounted hoist, comprising a motor and at least two wheels arranged to run along a rail, wherein the displaceable device comprises at least one motion wheel and at least one carrying wheel, wherein said motion wheel is rotatably fixed on a hinged bracket which is pivotably connected via a hinge to a chassis, wherein said motion wheel rolls on a longitudinally extending running surface of the rail when an actionable pressing means presses the friction wheel against said running surface in order to allow a displacement of the device along the rail when the motor is activated, and wherein said at least one carrying wheel is rotatably fixed on said chassis and able to rotate freely along the rail when said pressing means is deactivated.

A displaceable device of this kind comprising a motor is described in German reference DE-B-11 25 614. In this reference the device is arranged to run along a rail having a double-T-profile, wherein the motor and an actionable pressing device are together activate at the same time by means of compressed air in order to press the friction wheel against the friction surface of the rail. This device is provided with a transmission chain.

Other known rail mounted hoisting devices have a carriage with two sets of wheels placed in a rail or track. These wheels carry the weight of the hoist and its load, and at least two of these wheels are connected by a motion transmission means, for example by a chain, to a motor inside the carriage.

A travelling mechanism of a similar kind for moving a lifting device supporting a load along a rail is described in U.S. Pat. No. 6,050,198. This mechanism comprises a drivable friction wheel rotatably mounted on a first arm of a double lever which has a second arm supportably connectable to a lifting device, and the double lever urges said friction wheel against a friction surface of the rail. In this mechanism. said urging force is dependent on an amount of weight of the load supported by the lifting device.

The brake unit with a solenoid described in United Kingdom Patent Specification No. 495,377 relates to a special brake for a travelling hoist and the like track apparatus intended for retaining a traveller or movable element in a determined position. This brake is an element for reducing the movement of a displaceable device and bringing it to a stop by means of pressure on the wheels.

Due to the use of a carriage and/or special cinematic transmission means these devices are too expensive.

It is therefore an object of the invention to create a rail mounted or suspended displaceable device which avoids this shortcomings.

This object is advantageously achieved in accordance with the invention by a rail mounted displaceable device as defined above, characterized in that the pressing means includes a solenoid unit having a portion connected to the chassis and a portion connected the hinged bracket in order to lift the hinged bracket and press the motion wheel against said running surface of the rail.

Owing to a novel drive principle, a very simple and low cost drive for a device mounted at a ceiling rail or track is disclosed.

Further advantageous embodiments of the invention ensue from the appended dependent claims.

Figure 2:
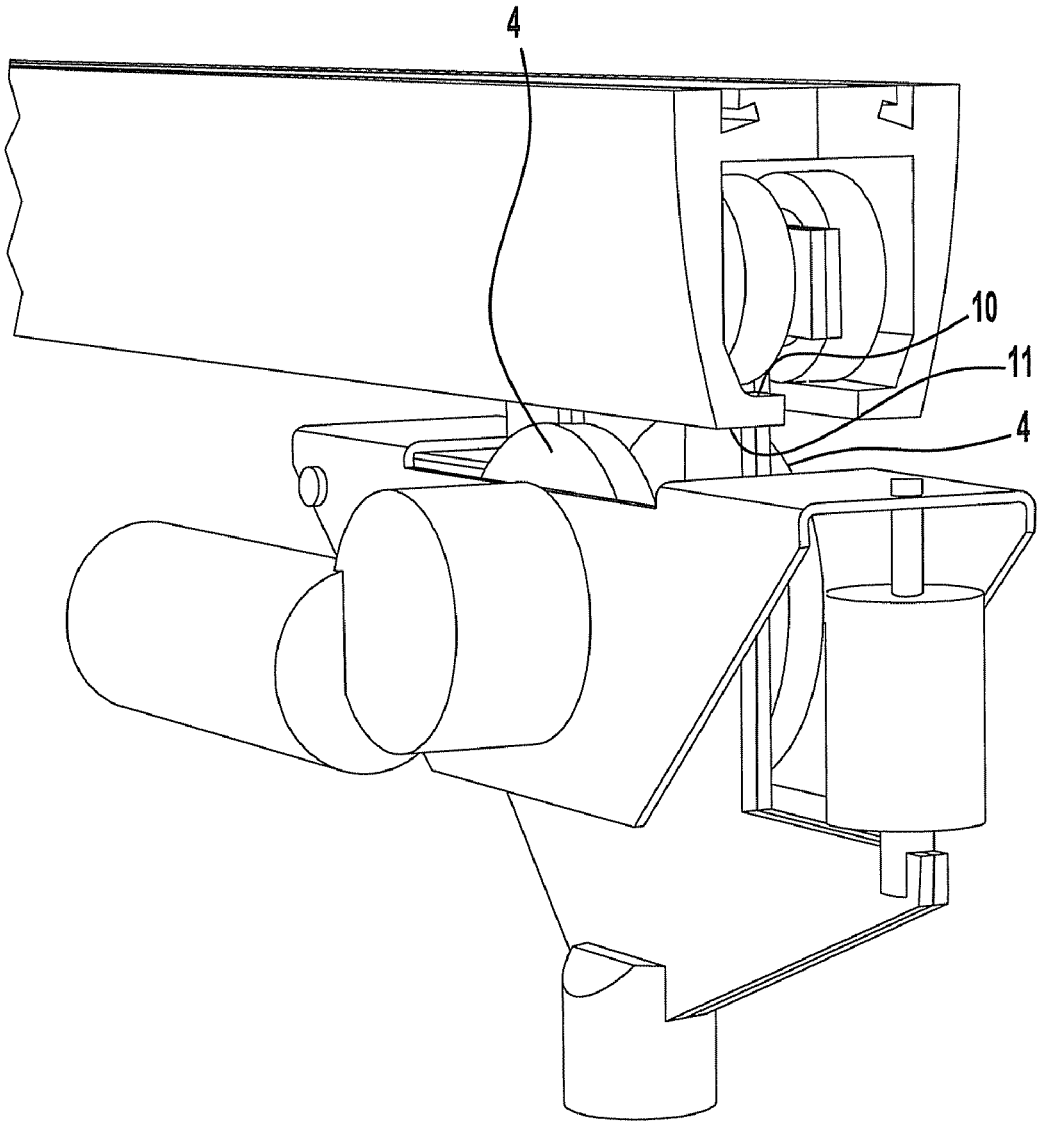
Figure 3:
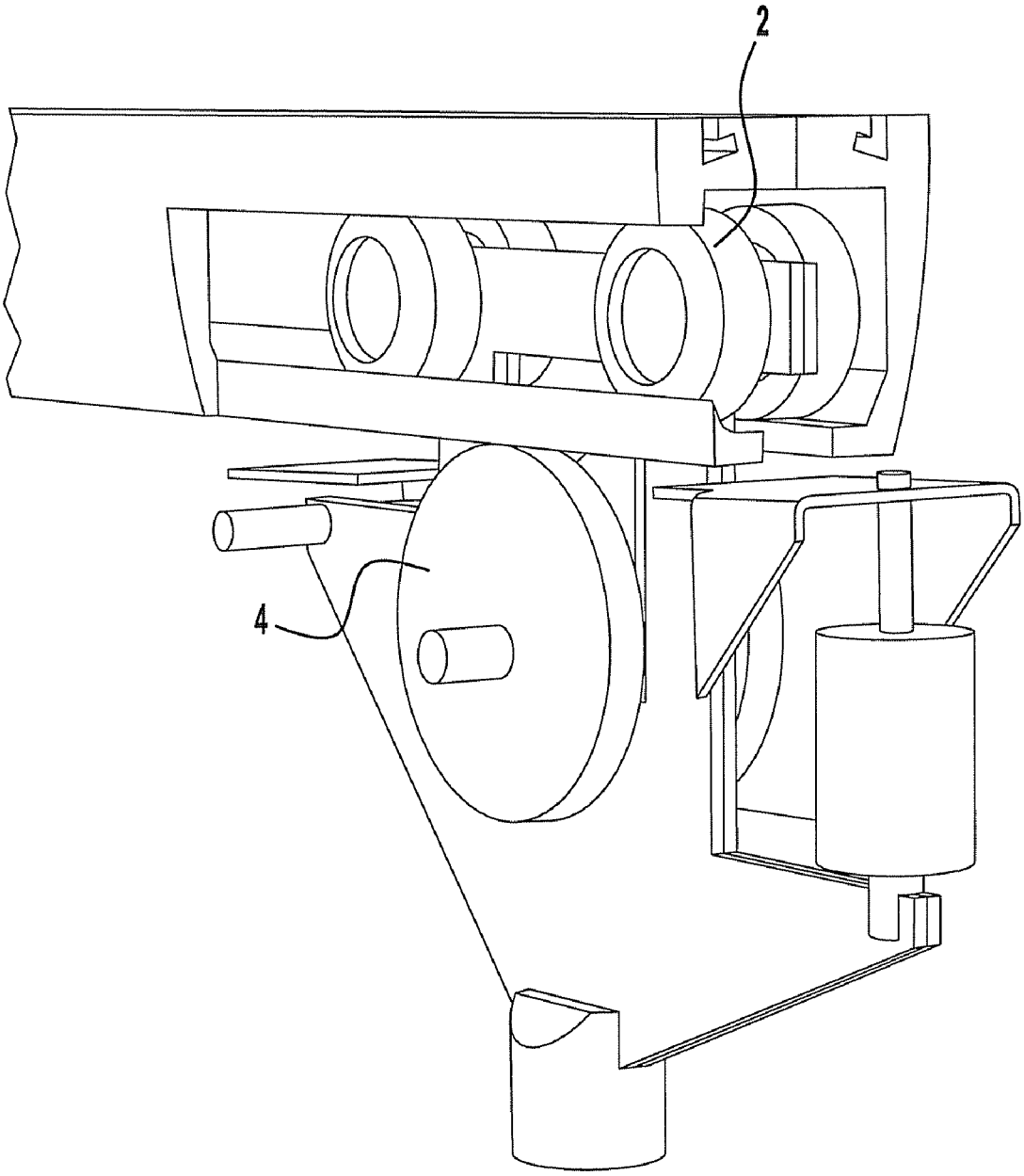
Figure 4:
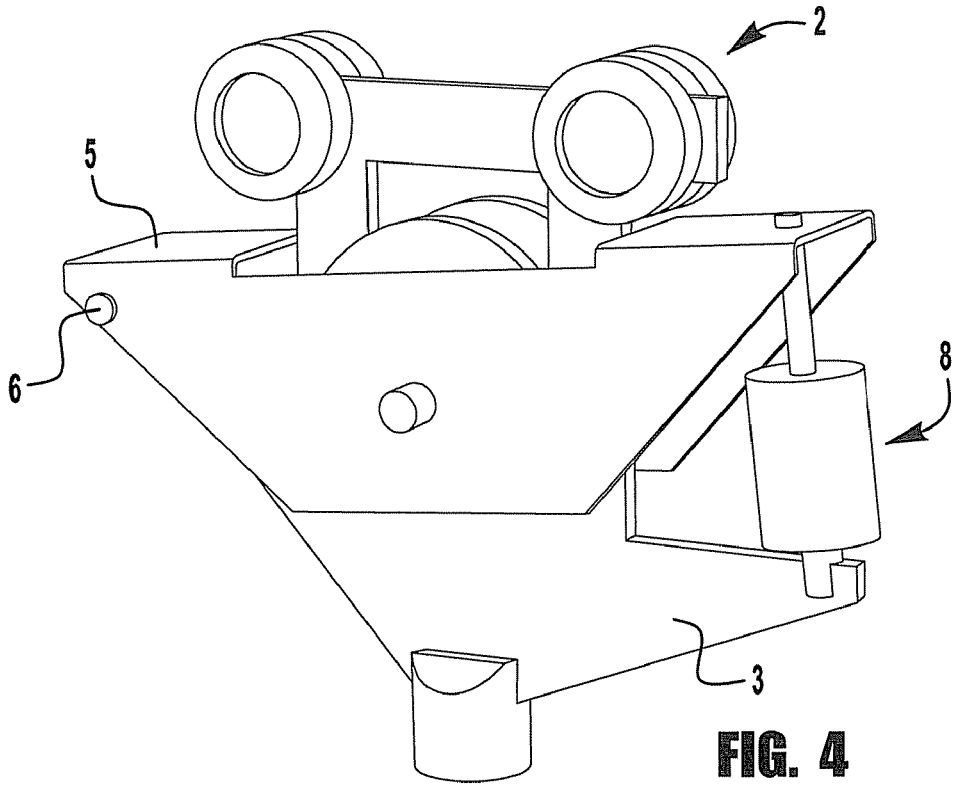
Figure 5:
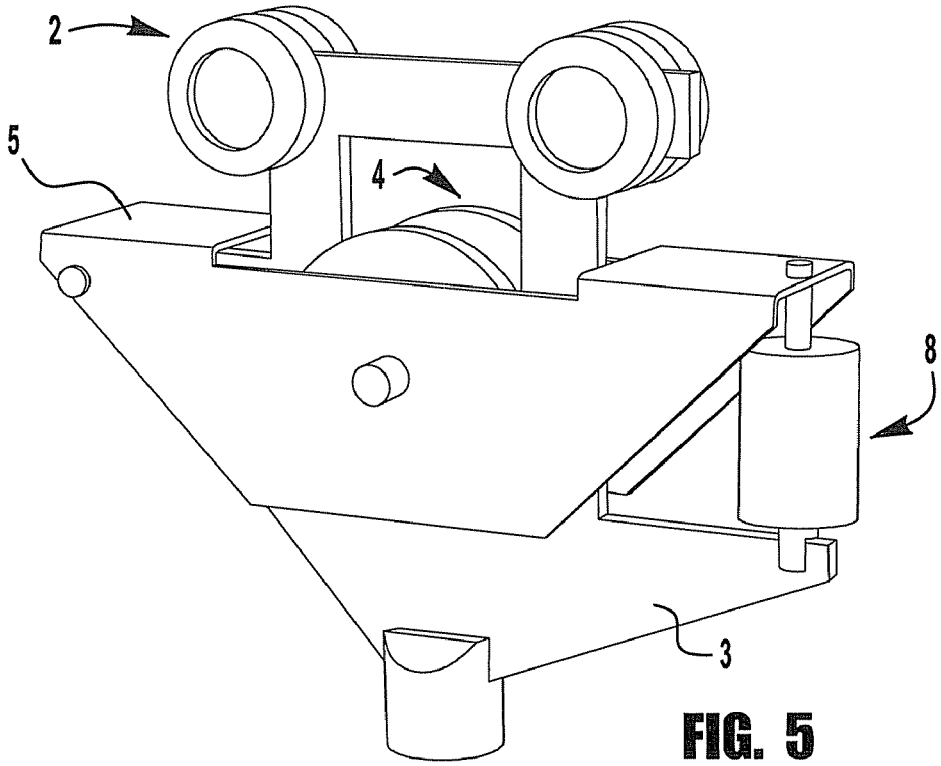

The invention will be explained in greater detail in what follows by means of drawings. Schematically shown are in:

FIG. 1 a perspective representation of a displaceable device according to the invention in an activated motor modus, FIG. 2 a representation of said device in a deactivated modus, FIG. 3 a detail of the device in the activated modus, FIG. 4 a detail of the device without rail in the activated modus, and FIG. 5 a detail of he device without rail in the deactivated modus.

The disclosed invention may be implemented in many ways sharing common characteristics. FIG. 1 is a general schematic representation of the displaceable device secured partially below a suspended rail. The track or rail 1 may be mounted at the ceiling or at an upper position, e.g. in an overhead location. According to the invention, the displaceable device includes a carrying wheel set 2 arranged to run in the track and a chassis 3 on which the wheels 2 are rotatably fixed. Two additional motion or transport wheels 4 are rotatably fixed on a hinged bracket 5 which is pivotably connected via a hinge 6 to the chassis 3. The motion wheels 4 and a motor or a motor unit 7 are supported by the hinged bracket 5.

The displaceable device according to the invention is provided with an actionable pressing means, for example a solenoid or a solenoid unit 8 for pressing the motion wheels against the track. In the embodiment of FIG. 1, the solenoid unit includes a solenoid accommodated in a cylindrical box 8 and two bolts or pistons 12, 13 protruding from the two plain surfaces of the cylindrical box.

The first one 12 of these bolts is fixed attached on the box, and the second bolt 13 is partially mounted in the interior of the box and displaceable along its longitudinal axis. The end of the first bolt 12 is connected to a point of the chassis 3 and the end of the second bolt is arranged to press against a point of the hinged bracket 5 or vice-versa. According to another embodiment of the invention, the box of a solenoid or an actionable pressing means 8 is connected to a point of the chassis 3 and a piston or bolt emerging from the solenoid is arranged to press against a point of the hinge bracket 5, or vice-versa.

Preferably, a mounting cylinder 9 for a hoist is attached on the lowest portion of the chassis 3. The transport wheels 4 are for example made of rubber.

The hinged bracket 5 according to FIG. 1 is a frame which in front view is shaped like an inverted U having on its upper side a part cut away through which a portion of the chassis 3 is accommodated. Preferably, the axis of the hinge 6 which pivotably connects the hinged bracket 5 to the chassis 3 is parallel to the axes of the motion wheels 4. In front view, the idealized contour of rail 1 is shaped like two square brackets with a superior straight line connecting the upper horizontal lines of the brackets, whereas the lower short horizontal lines of the brackets constitute the active strips of the rail, being located one on the left and one on the right of the rail. Both strips have each an upper rolling surface 10 for the carrying wheels 2 and a lower rolling surface 11 for the motion wheels 4. The carrying wheels 2 can run in the track 1 permanently touching the upper rolling surface of said strips, and when the motor 7 is set in operation the motion wheels 4 are pressed from below against the lower rolling surfaces of the strips, as shown in FIG. 2.

When the solenoid is deactivated, there is no contact between the motion wheel 4 and the lower rolling surfaces, as seen in FIG. 2.

The present invention comprises also embodiments for which the expression "rail mounted" includes that the displaceable device may be partially rail suspended. Furthermore, the rail may be unsymmetrical having the running strips on different levels, and the displaceable device may have three wheels only.

FIG. 3 shows a device in which a part of the track is cut away. This makes it possible to see that the system preferably comprises two pairs of carrying wheels 2 inside the track. The motor unit and a part of the hinged bracket are also removed, in order to make visible that the system preferably includes two coaxially disposed motion wheels of same diameter. In the case of FIG. 3 and 4, the motion wheels 4 are pressed against the track by effect of the activated solenoid 8, whereas with deactivated solenoid 8 (FIG. 5), there is an air-gap between the transport wheels 4 and the rail 1, so that nothing prevents the carrying wheels 2 to rotate freely along the track 1.

A hand-operated controller or command, not shown in the figures as it is a common means for the man skilled in the art, is provided to activate the motor 7 and/or the solenoid 8. Said controller, which is provided with at least one control-button, may be remote or mounted at the hosting device. Alternatively, a rotating contact set may be placed at the mounting cylinder 9 in order to activate the motor unit. When the control button is activated, the motor unit will be supplied with current, for example from the hoist via said rotating contact set placed at said mounting cylinder 9, and the current flows to the motor 7 and the solenoid 8. The solenoid 8 lifts the hinged bracket 5 with the motion wheels 4 which are pressed against the underside of the track 1, and the device mounted at the ceiling rail 1 runs in a desired direction. The solenoid 8 and the motor 7 may be operated by two extra buttons of the same hand-operated controller that operates the lifting function of the lift.

Generally, the motor and the solenoid or pressing means are operated simultaneously. In a first embodiment of the invention, when the button at the hand-operated controller is released the motor 7 and the solenoid 8 stop immediately. When the solenoid is deactivated, the motor unit is no more pressed against the track and falls by effect of its dead weight and/or a spring (not shown) to an inferior position supported by the solenoid 8 or by a special stop not shown in the drawings.

This means that the carrying wheels 2 are able of rotating although the motor is not running, and this allows to make a desired slight adjustment of the position of the hoist along the track which can be done by hand by pulling the hoist in the sling. In other words, when after operation the motor is disconnected, it will be possible to move the hoist manually along the track.

In a further embodiment of the invention, a delay circuit is provided preferably in the pressing means or solenoid unit 8, so that when the button of the hand-operated controller is released the motor 7 stops immediately, while the delay circuit prevents the pressing means or the solenoid 8 to be released for a predetermined time t, which my be for example about 3 seconds in order to prevent the hoist to continue moving along the track by inertia, when the motor is stopped.

The advantages of the invention are that the hoist can be moved manually for small movements such as adjustment of the position over a bed, a chair etc., that if for some reasons the motor units fails, the normal function of the hoist lift can still be used, and that if for-some reason the entire system, hoist and motor unit fails during operation a person in the hoist can be moved to a proper place and be lowered by the emergency function of the hoist.

The motor unit 7 may be a standard motor unit or a motor with worm gear, and the transport wheels 4 may be made of rubber or of another material, as long as they have sufficient friction and durability. The transport wheels 4 can be gear wheels collaborating with a rack at the track. The solenoid 8 is a standard unit. As depicted in FIG. 1, the motor 7 may be mounted at the outward side of the chassis 3. In certain cases a counterweight may be placed on the other side of the chassis 3. Preferably, an electric motor with an accumulator-battery 14 (FIG. 1) may be used. The motor 7 and/or the solenoid 8 may be power supplied from a battery accommodated for example in the motor unit or in the hoist or in said counterweight.

In the sense of the invention, a solenoid unit may be in general an electromagnet unit including a coil, a core of a soft magnetic material and/or a yoke or armature whatever its shape, and the motion wheel 4 may be a drivable friction wheel which rolls on a longitudinally extending rolling surface of the rail when a suitable actionable pressing means 8 presses the friction wheel 4 against the friction surface of the rail in order to allow a displacement of the device along the rail 1 when the motor 7 is activated. Preferably, however, the solenoid has a cylindrical shape and may be vertically mounted.

In a preferred embodiment of the invention the chassis 3 is a plate, preferably with a substantially constant thickness and having an end portion arranged to be attached to said carrying wheels 2. The chassis 3 may be vertically mounted and may have a rectangular cut away portion to accommodate the solenoid. It may have some recesses in order to reduce its weight. Preferably, the shape of the chassis 3 is that of an irregular polygon with a maximum transversal extension approximately on an area between the hinge 6 and the point fixed to the solenoid unit 8 as depicted in the figures. The maximum vertical extension may be larger than said transversal extension.

Preferably, the bracket 5 has a substantially inverted U-profile having an opening on its upper portion, wherein said end portion of the plate 3 protrudes from said opening of said inverted U-profile. Furthermore, the device in accordance with the invention may be arranged to run along a rail of the hollow-profile-type having a slit open toward the bottom and running surfaces arranged in the interior, wherein said end portion of the chassis 3 is introduced into said slit.

The principle of the invention is not limited to the described components, since it can also be carried out in other combinations such as having a pneumatic system or a servo motor. The invention represents a realistic solution with respect to cost, noise and use of standard components.

The invention may be used in health care systems as patient lifts or the like. It is within the scope of the present invention to cover other modifications according to the principle of the disclosed embodiments.

The invention claimed is:

1. A rail mounted displaceable device for a ceiling mounted hoist, comprising: a motor and at least two wheels arranged to run along a rail, wherein the displaceable device comprises at least one motion wheel and at least one carrying wheel, wherein said motion wheel is rotatably fixed on a hinged bracket which is pivotably connected via a hinge to a chassis, wherein said motion wheel rolls on a longitudinally extending running surface of the rail when an actionable pressing means presses the motion wheel against said running surface in order to allow a displacement of the device along the rail when the motor is activated, wherein said at least one carrying wheel is rotatably fixed on said chassis and able to rotate freely along the rail when said pressing means is deactivated, wherein the pressing means includes a solenoid unit having a portion connected to the chassis and a portion connected the hinged bracket in order to lift the hinged bracket and press the motion wheel against said running surface of the rail, wherein the chassis is a plate having a substantially constant thickness and an end portion arranged to be attached to said carrying wheels, and wherein the bracket has a substantially inverted U-profile having an opening on its upper portion, and wherein said end portion of the plate protrudes from said opening of said inverted U-profile.

2. Device in accordance with claim 1, wherein the solenoid unit is accommodated between the bracket and the chassis and has one bolt protruding from a top plane of the solenoid unit pressing against the hinged bracket or pressing against the chassis.

3. Device in accordance with claim 1, wherein the solenoid unit is accommodated in a cylindrical box having two bolts protruding from the two opposite plane surfaces of the cylindrical box, and wherein the first of said bolts is attached on the box, and the second bolt is partially located in the interior of the box and displaceable along its longitudinal axis.

4. Device in accordance with claim 3, wherein the first bolt attached on the box is connected to a point of the chassis and the second bolt is arranged to press against a point of the hinged bracket or wherein the first bolt attached on the box is arranged to press against a point of the hinged bracket and the second bolt is connected to a point of the chassis.

5. Device in accordance with claim 1, wherein the motor is fixed to the hinged bracket.

6. Device in accordance with claim 1, wherein the device is arranged to run along a rail of a hollow-profile-type having a slit open toward the bottom and running surfaces arranged in an interior, and wherein said end portion of the chassis is introduced into said slit.

7. Device in accordance with claim 1, wherein a delay means is provided, so that when a command is released to stop the motor, the delay means prevents the pressing means to be released for a predetermined time t, in order to prevent the device from continuing to move along the rail by inertia, when the motor is stopped.

8. Device in accordance with claim 7, wherein the delay means are electric or electronic means to delay the command for the solenoid.

9. Device in accordance with claim 7, wherein the time t is adjustable according to characteristics of the device.

10. A rail mounted displaceable device for a ceiling mounted hoist, comprising: a motor and at least two wheels arranged to run along a rail, wherein the displaceable device comprises at least one motion wheel and at least one carrying wheel, wherein said motion wheel is rotatably fixed on a hinged bracket which is pivotably connected via a hinge to a chassis, wherein said motion wheel rolls on a longitudinally extending running surface of the rail when an actionable pressing means presses the motion wheel against said running surface in order to allow a displacement of the device along the rail when the motor is activated, wherein said at least one carrying wheel is rotatably fixed on said chassis and able to rotate freely along the rail when said pressing means is deactivated, wherein the pressing means includes a solenoid unit having a portion connected to the chassis and a portion connected the hinged bracket in order to lift the hinged bracket and press the motion wheel against said running surface of the rail, wherein the chassis is a plate having a substantially constant thickness and an end portion arranged to be attached to said carrying wheels, wherein the bracket has a substantially inverted U-profile having an opening on its upper portion, wherein said end portion of the plate protrudes from said opening of said inverted U-profile, wherein the device is arranged to run along a rail of a hollow-profile-type having a slit open toward the bottom and running surfaces arranged in an interior, and wherein said end portion of the chassis is introduced into said slit.

11. Device in accordance with claim 10, wherein a delay means is provided, so that when a command is released to stop the motor, the delay means prevents the pressing means to be released for a predetermined time t, in order to prevent the device from continuing to move along the rail by inertia, when the motor is stopped.

12. Device in accordance with claim 11, wherein the delay means are electric or electronic means to delay the command for the solenoid.

13. Device in accordance with claim 11, wherein the time t is adjustable according to characteristics of the device.

14. A rail mounted displaceable device for a ceiling mounted hoist, comprising: a motor and at least two wheels arranged to run along a rail, wherein the displaceable device comprises at least one motion wheel and at least one carrying wheel, wherein said motion wheel is rotatably fixed on a hinged bracket which is pivotably connected via a hinge to a chassis, wherein said motion wheel rolls on a longitudinally extending running surface of the rail when an actionable pressing means presses the motion wheel against said running surface in order to allow a displacement of the device along the rail when the motor is activated, wherein said at least one carrying wheel is rotatably fixed on said chassis and able to rotate freely along the rail when said pressing means is deactivated, wherein the pressing means includes a solenoid unit having a portion connected to the chassis and a portion connected the hinged bracket in order to lift the hinged bracket and press the motion wheel against said running surface of the rail, wherein the chassis is a plate having a substantially constant thickness and an end portion arranged to be attached to said carrying wheels, wherein the bracket has a substantially inverted U-profile having an opening on its upper portion, wherein said end portion of the plate protrudes from said opening of said inverted U-profile, wherein a delay means is provided, so that when a command is released to stop the motor, the delay means prevents the pressing means to be released for a predetermined time t, in order to prevent the device from continuing to move along the rail by inertia, when the motor is stopped and wherein the delay means are electric or electronic means to delay the command for the solenoid.

15. Device in accordance with claim 14, wherein the time t is adjustable according to characteristics of the device.

* * * * *